US010904959B2

(12) United States Patent
Carcano et al.

(10) Patent No.: US 10,904,959 B2
(45) Date of Patent: Jan. 26, 2021

(54) APPARATUS AND SYSTEM FOR SOLID STATE OVEN ELECTRONICS COOLING

(71) Applicant: ILLINOIS TOOL WORKS INC., Glenview, IL (US)

(72) Inventors: Marco Carcano, Senago (IT); Michele Gentile, Jesi (IT); Michele Sclocchi, San Donato Milanese (IT)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 353 days.

(21) Appl. No.: 15/810,852

(22) Filed: Nov. 13, 2017

(65) Prior Publication Data

US 2018/0152992 A1 May 31, 2018

Related U.S. Application Data

(60) Provisional application No. 62/427,912, filed on Nov. 30, 2016.

(51) Int. Cl.
*H05B 6/64* (2006.01)
*H05B 6/68* (2006.01)

(52) U.S. Cl.
CPC ..... *H05B 6/642* (2013.01); *H05B 6/686* (2013.01)

(58) Field of Classification Search
CPC ..... H05B 6/642; H05B 6/686
See application file for complete search history.

(56) References Cited

U.S. PATENT DOCUMENTS 3,127,495 A * 3/1964 Polries ..... H05B 6/642 219/757
3,308,261 A * 3/1967 Velander ..... H05B 6/642 219/757
3,536,878 A * 10/1970 Fitzmayer ..... H05B 6/6482 219/750

(Continued)

FOREIGN PATENT DOCUMENTS

EP 2778539 A1 9/2014
EP 3035773 A1 6/2016

(Continued)

OTHER PUBLICATIONS

International Search Report and Written Opinion of PCT/US2017/062172 dated Mar. 2, 2018, all enclosed pages cited.

*Primary Examiner* — Donnell A Long
(74) *Attorney, Agent, or Firm* — Burr & Forman, LLP

(57) ABSTRACT

An air circulation system for an oven includes an inlet cavity, an attic region and a cooling fan. The oven includes a cooking chamber configured to receive a food product and an RF heating system configured to provide RF energy into the cooking chamber using solid state electronic components. The air circulation system is configured to provide air for cooling the solid state electronic components. The inlet cavity is disposed below the cooking chamber. The attic region is disposed above the cooking chamber and housing the solid state electronic components. The cooling fan isolates the inlet cavity from the attic region to maintain the inlet cavity at a pressure below ambient pressure to draw cooling air into the inlet cavity via an inlet array, and to maintain the attic region at a pressure above ambient pressure to discharge air that has cooled the solid state electronic components from an oven body of the oven.

18 Claims, 8 Drawing Sheets

(56) References Cited

U.S. PATENT DOCUMENTS 3,576,417 A * 4/1971 Tingley ..... H05B 6/6414 219/739
3,783,219 A * 1/1974 Tateda ..... H05B 6/642 219/757
3,878,350 A * 4/1975 Takagi ..... F24C 7/02 219/685
2006/0157479 A1* 7/2006 Claesson ..... H05B 6/6426 219/681
2007/0131220 A1* 6/2007 Kim ..... F04D 29/4226 126/273 R
2011/0017729 A1* 1/2011 Choi ..... H05B 6/642 219/730
2011/0049124 A1* 3/2011 Crayfourd ..... F24C 15/006 219/400
2011/0209626 A1* 9/2011 Underwood ..... F24C 15/025 99/357
2012/0043318 A1* 2/2012 Komuro ..... F24C 15/2007 219/757
2014/0305320 A1* 10/2014 Kamii ..... H05B 6/642 99/443 R
2016/0025352 A1* 1/2016 Lee ..... F24C 15/006 219/391
2016/0183332 A1* 6/2016 Frank ..... H05B 6/642 219/728
2016/0212801 A1* 7/2016 Nishijima ..... H05B 6/642
2016/0330800 A1* 11/2016 Hayashi ..... H05B 6/642
2017/0150554 A1* 5/2017 Shoup ..... H05B 6/645
2017/0347409 A1* 11/2017 De Luca ..... H05B 6/6482
2017/0359863 A1* 12/2017 Frank ..... H05B 6/686
2018/0288834 A1* 10/2018 Li ..... H05B 6/6426
2019/0008004 A1* 1/2019 Wild ..... A21B 3/04

FOREIGN PATENT DOCUMENTS

GB 2127260 A 4/1984
JP S58106792 A 6/1983
JP S6017891 A 1/1985
JP 2005180801 A 7/2005

* cited by examiner

APPARATUS AND SYSTEM FOR SOLID STATE OVEN ELECTRONICS COOLING

CROSS REFERENCE TO RELATED APPLICATIONS

This application claims priority to U.S. application No. 62/427,912 filed Nov. 30, 2016, the entire contents of which are hereby incorporated by reference in its entirety.

TECHNICAL FIELD

Example embodiments generally relate to ovens and, more particularly, relate to an oven that uses radio frequency (RF) heating provided by solid state electronic components and the cooling of those components.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for applying heat to the food product in the oven. Moreover, such improvements may necessitate new arrangements for supporting or operating such structures or systems. In particular, for an oven that uses solid state components, instead of a magnetron, to generate RF energy, the cooling of the solid state components may be important. Example embodiments may provide improved capabilities for providing such cooling.

In an example embodiment, an oven is provided. The oven includes an oven body, a cooking chamber disposed in the oven body and configured to receive a food product, an RF heating system configured to provide RF energy into the cooking chamber using solid state electronic components, and an air circulation system configured to provide air for cooling the solid state electronic components. The air circulation system may include an inlet cavity disposed below the cooking chamber, an attic region disposed above the cooking chamber and housing the solid state electronic components, and a cooling fan. The cooling fan may isolate the inlet cavity from the attic region to maintain the inlet cavity at a pressure below ambient pressure to draw cooling air into the inlet cavity via an inlet array, and to maintain the attic region at a pressure above ambient pressure to discharge air that has cooled the solid state electronic components from the oven body.

In an example embodiment, an air circulation system for an oven having a cooking chamber configured to receive a food product is provided and an RF heating system configured to provide RF energy into the cooking chamber using solid state electronic components is provided. The air circulation system includes an inlet cavity, an attic region and a cooling fan. The air circulation system may be configured to provide air for cooling the solid state electronic components. The inlet cavity may be disposed below the cooking chamber. The attic region may be disposed above the cooking chamber and housing the solid state electronic components. The cooling fan may isolate the inlet cavity from the attic region to maintain the inlet cavity at a pressure below ambient pressure to draw cooling air into the inlet cavity via an inlet array, and may maintain the attic region at a pressure above ambient pressure to discharge air that has cooled the solid state electronic components from an oven body of the oven.

Some example embodiments may improve the cooking performance or operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
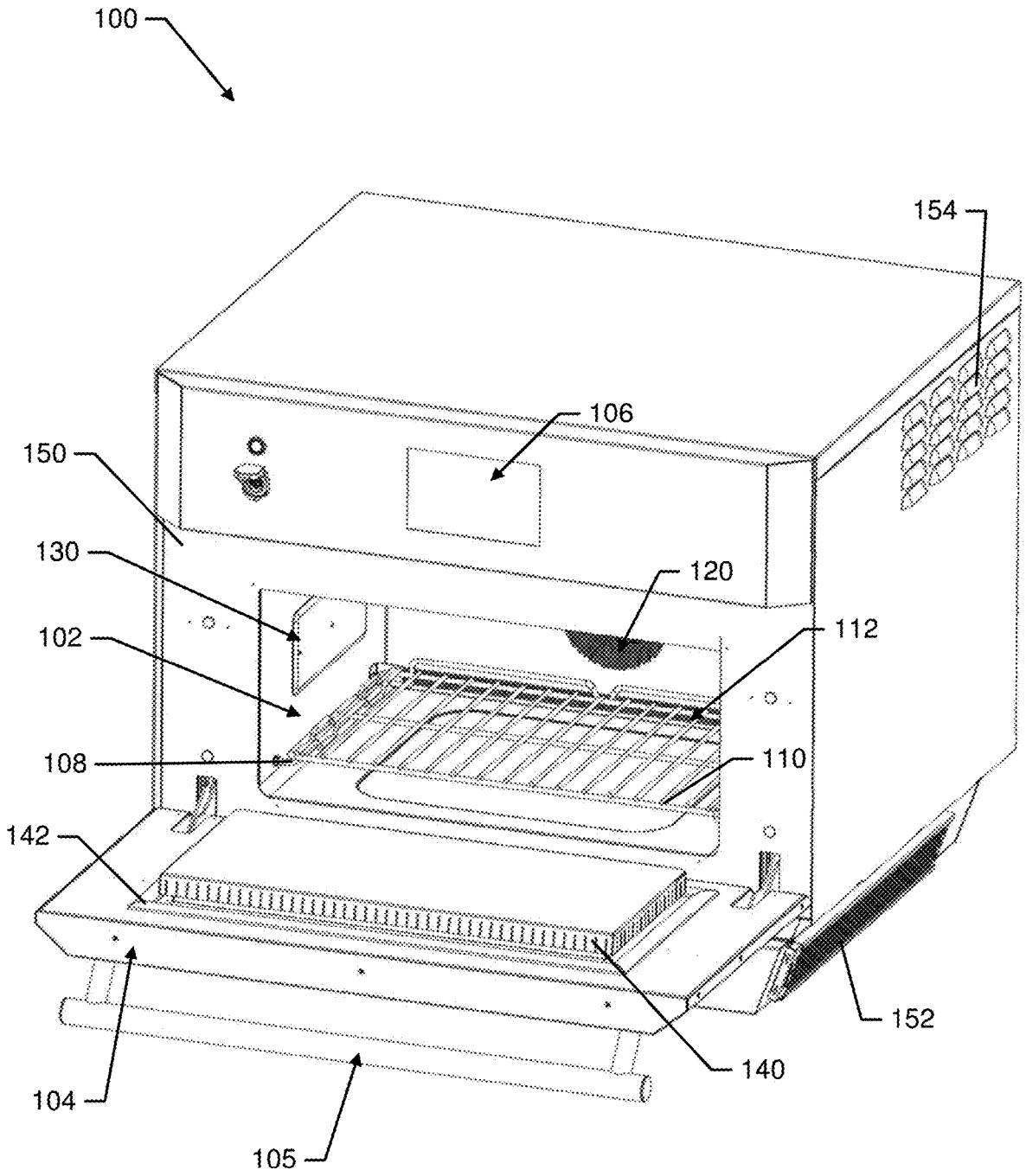
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly and uniformly, based on the application of RF energy under the instruction of control electronics that are effectively cooled by structures and systems of example embodiments. The structures and systems used to cool the control electronics may manage the heat load generated by the oven, but may also do so in a way that keeps the oven internal spaces clean, or at least leaves places that are easy to clean more susceptible to accumulation of dust and debris than those locations that are difficult to clean and have sensitive components therein.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the ground. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a back or rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. Furthermore, the inlet array 152 is at least partially shielded from any direct communication path from the outlet louvers 154 by virtue of the fact that, at the oven sides (which include both portions of the inlet array 152 and outlet louvers 154), the shape of the basement is such that the tapering of the inlet array 152 is provided on walls that are also slightly inset to create an overhang 158 that blocks any air path between inlet and outlet. As such, air drawn into the inlet array 152 can reliably be expected to be air at ambient room temperature, and not recycled, expelled cooling air.

Figure 2:
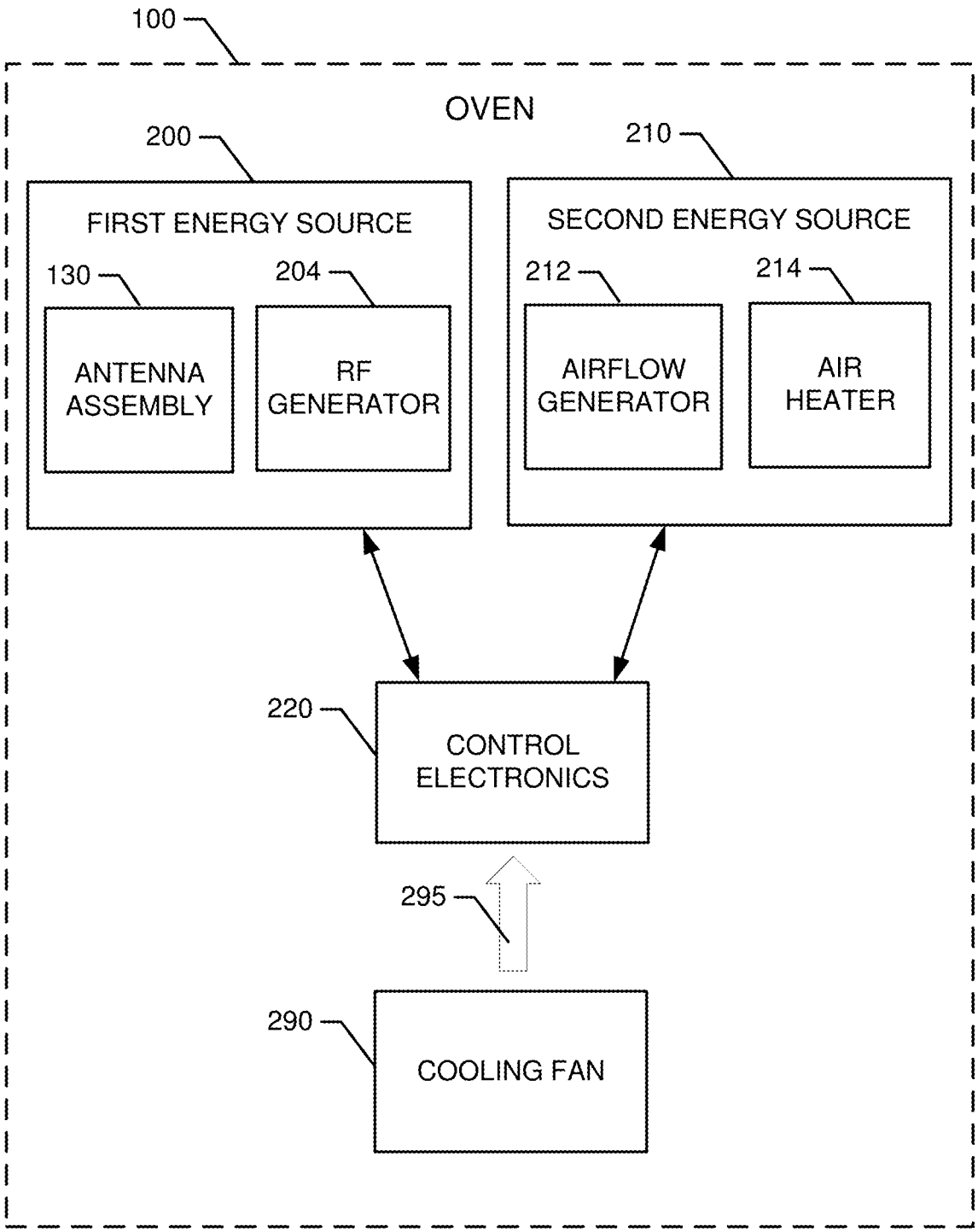
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

As discussed above, the first air circulation system may be configured to drive heated air through the cooking chamber 102 to maintain a steady cooking temperature within the cooking chamber 102. Meanwhile, the second air circulation system may cool the control electronics 220. The first and second air circulation systems may be isolated from each other. However, each respective system generally uses differential pressures (e.g., created by fans) within various compartments formed in the respective systems to drive the corresponding air flows needed for each system. While the airflow of the first air circulation system is aimed at heating food in the cooking chamber 102, the airflow of the second air circulation system is aimed at cooling the control electronics 220. As such, cooling fan 290 provides cooling air 295 to the control electronics 220, as shown in FIG. 2.

The structures that form the air cooling pathways via which the cooling fan 290 cools the control electronics 220 may be designed to provide efficient delivery of the cooling air 295 to the control electronics 220, but also minimize fouling issues or dust/debris buildup in sensitive areas of the oven 100, or areas that are difficult to access and/or clean. Meanwhile, the structures that form the air cooling pathways may also be designed to maximize the ability to access and clean the areas that are more susceptible to dust/debris buildup. Furthermore, the structures that form the air cooling pathways via which the cooling fan 290 cools the control electronics 220 may be designed to strategically employ various natural phenomena to further facilitate efficient and effective operation of the second air circulation system. In this regard, for example, the tendency of hot air to rise, and the management of high pressure and low pressure zones necessarily created by the operation of fans within the system may each be employed strategically by the design and placement of various structures to keep certain areas that are hard to access relatively clean and other areas that are otherwise relatively easy to access more likely to be places where cleaning is needed.

Figure 3:
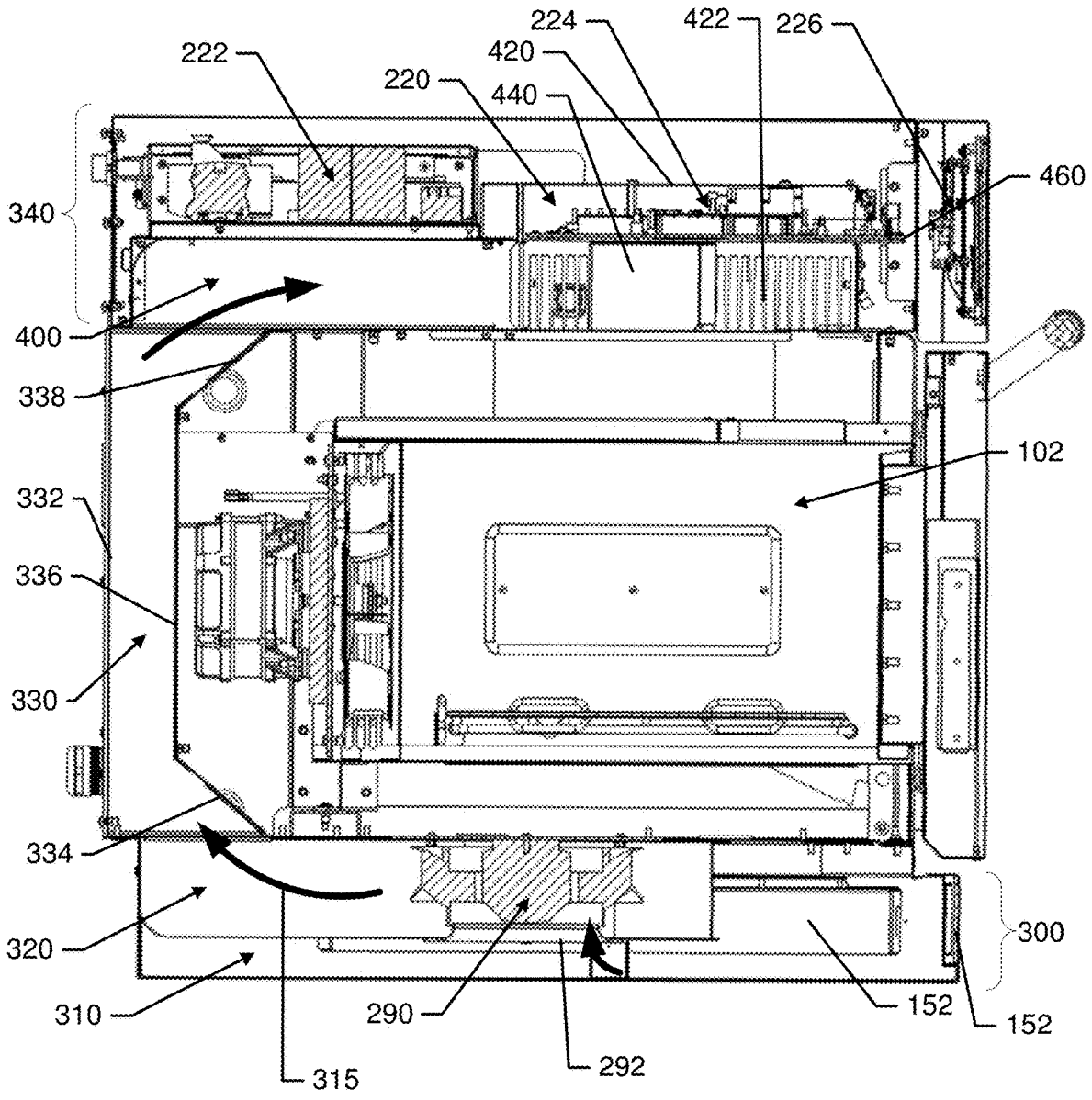
FIG. 3 shows a cross sectional view of the oven from a plane passing from the front to the back of the oven according to an example embodiment.
Figure 4:
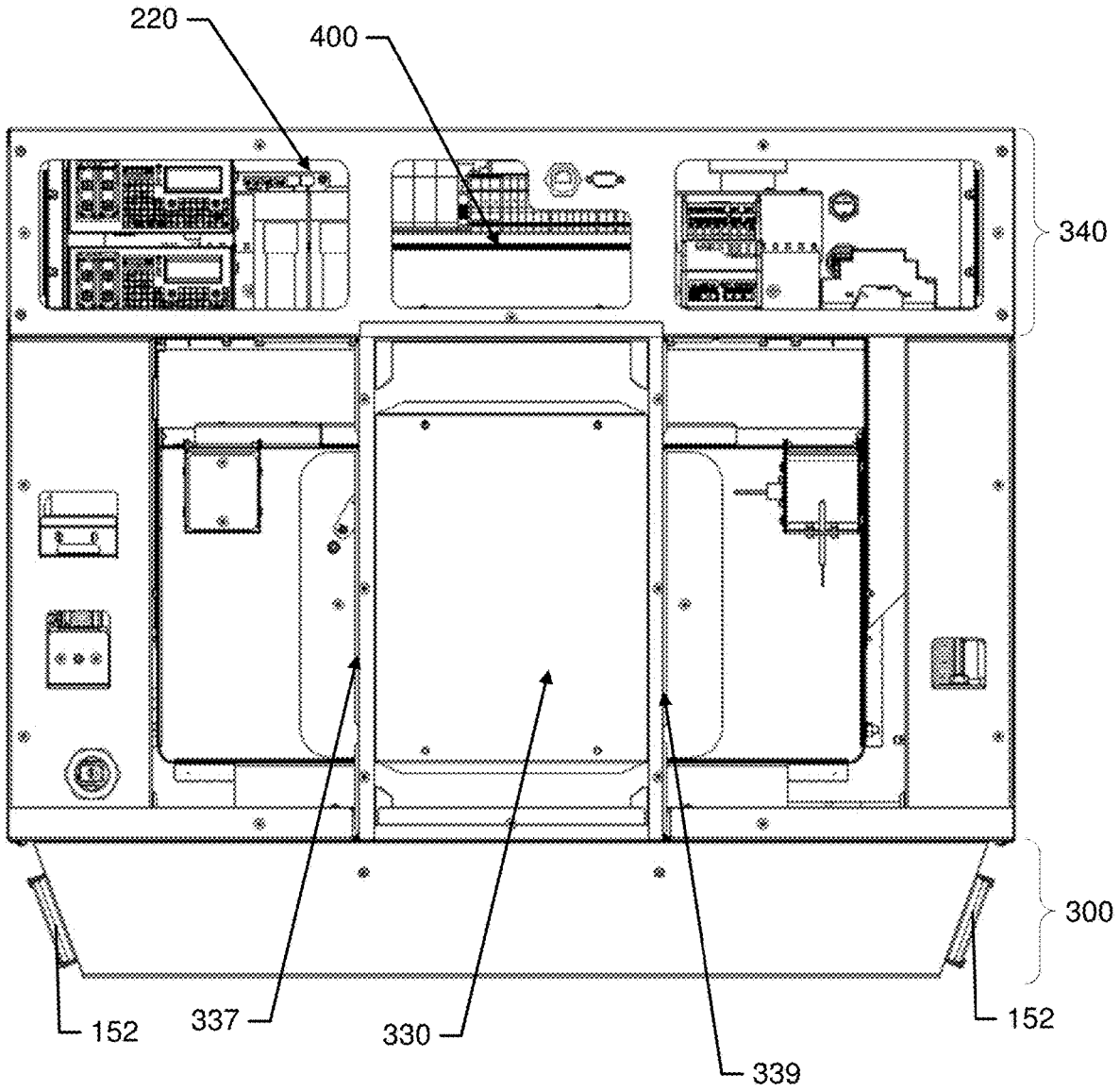
FIG. 4 is a back view of the oven with body panels removed to show various portions of a cooling air circulation system in accordance with an example embodiment.
Figure 5:
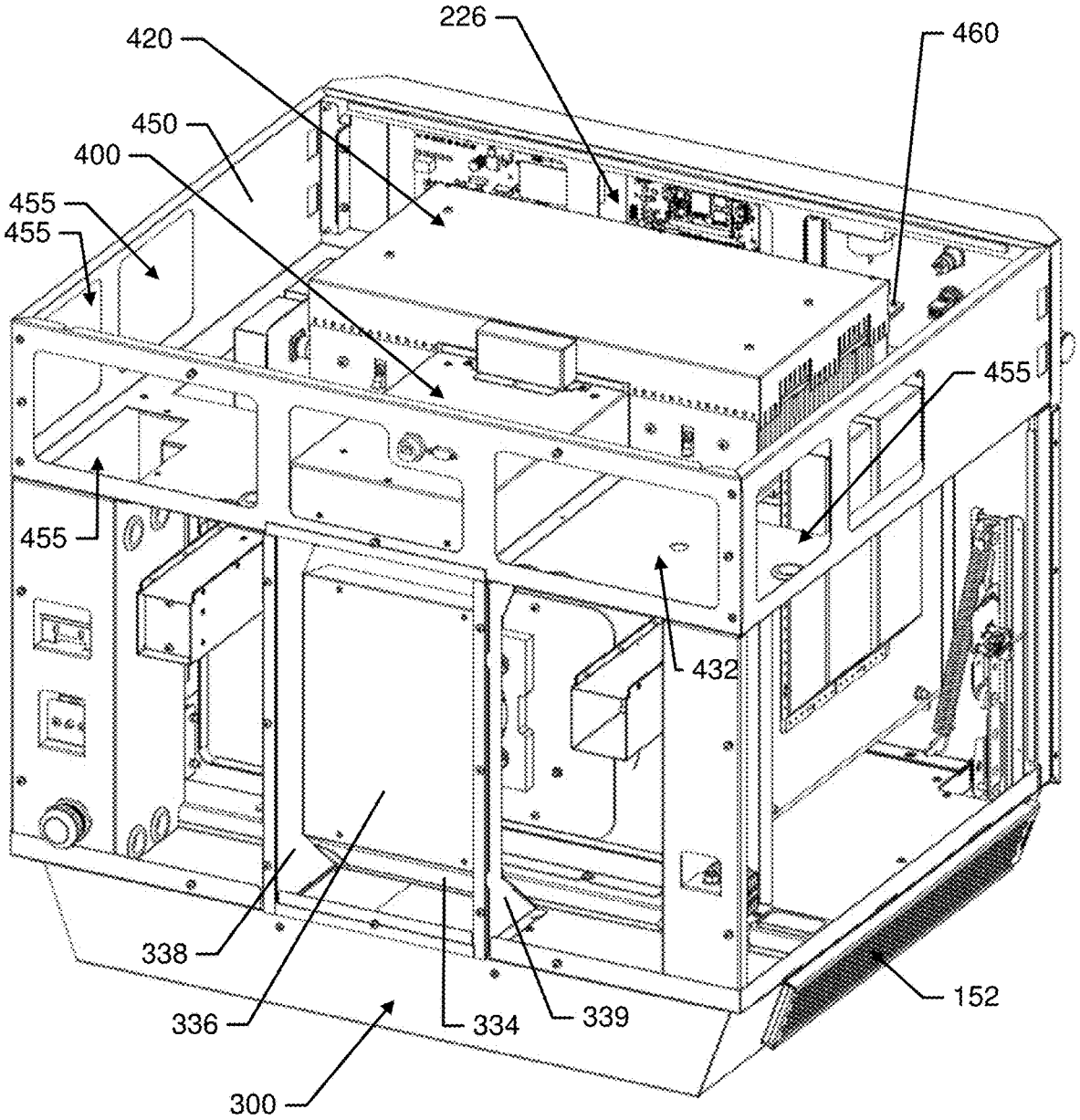
FIG. 5 is a rear perspective view of the oven with body panels removed to show various portions of cooling air circulation system in accordance with an example embodiment.
Figure 6:
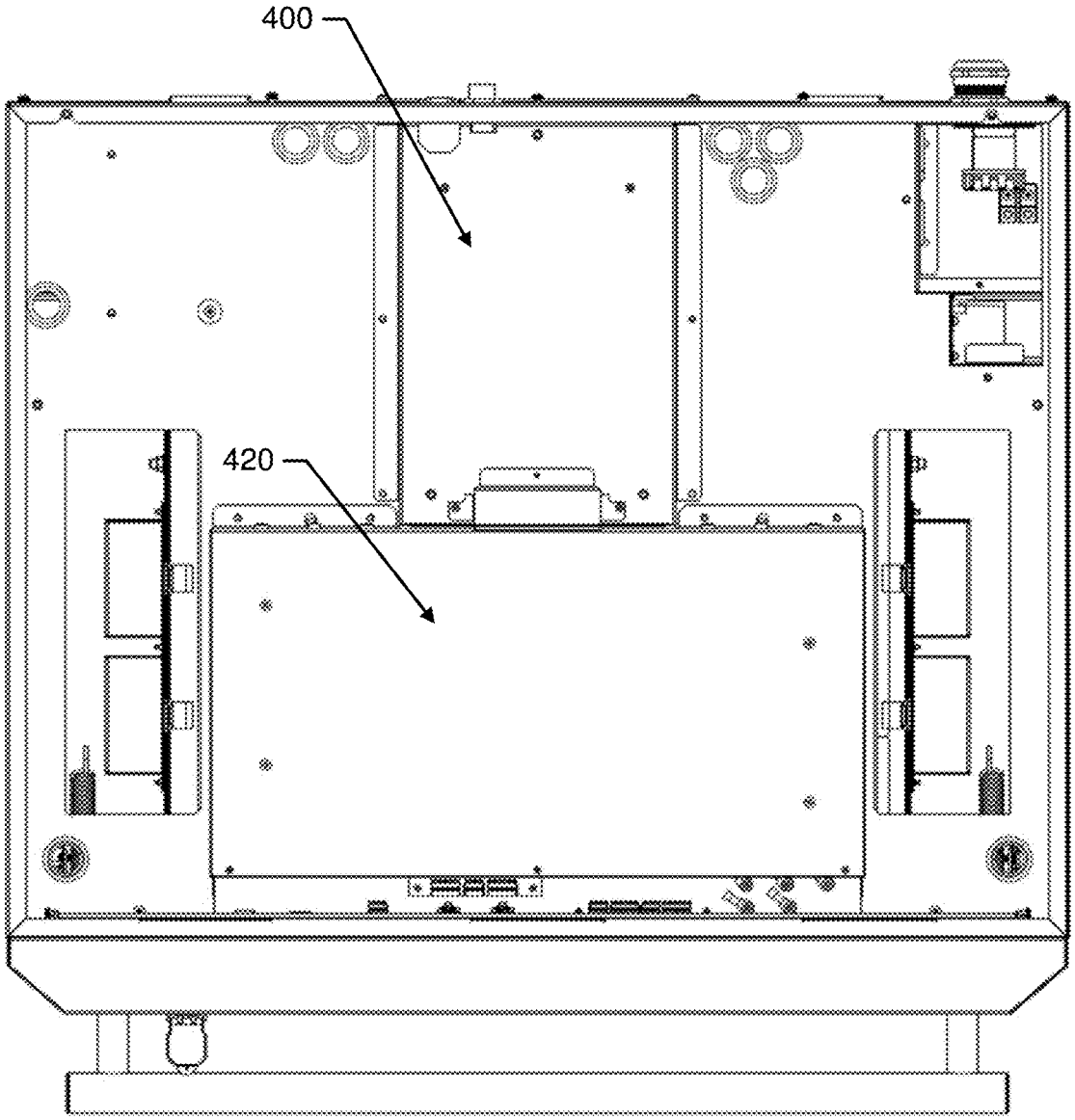
FIG. 6 is a top view of an attic portion of the oven to show various portions of the cooling air circulation system in accordance with an example embodiment.
Figure 7:
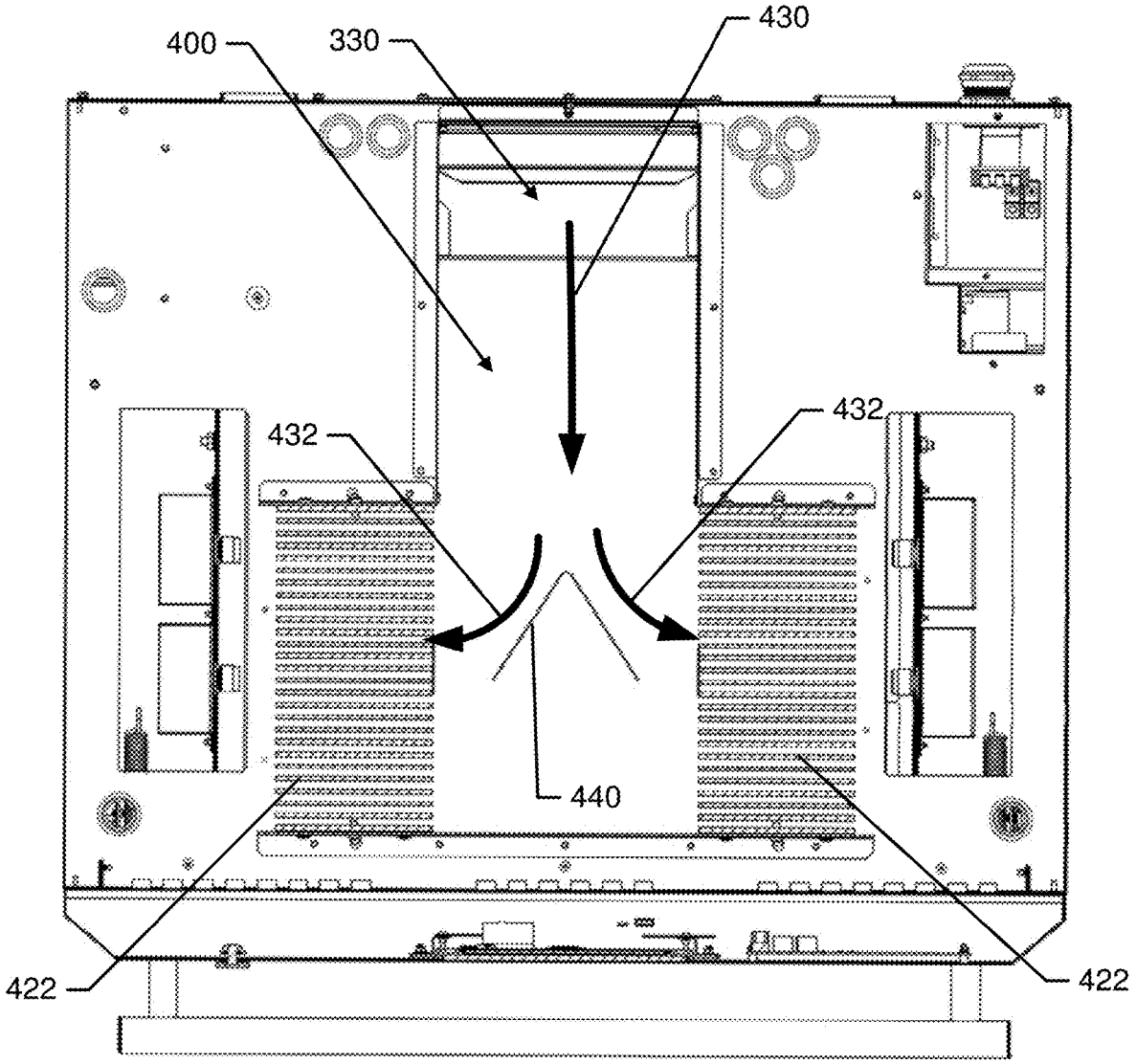
FIG. 7 is a cross sectional view of the attic portion of the oven to show where air flows in the attic portion of the cooling air circulation system in accordance with an example embodiment.
Figure 8:
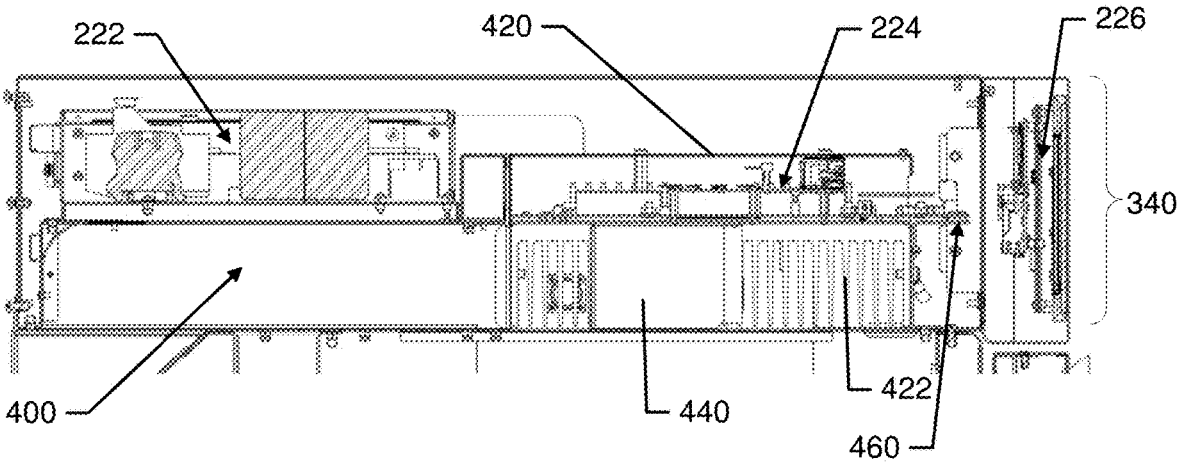
FIG. 8 is a side view of a cross section taken through the center of the attic portion from back to front in accordance with an example embodiment.

The typical airflow path, and various structures of the second air circulation system, can be seen from FIGS. 3-8. In this regard, FIG. 3 shows a cross sectional view of the oven 100 from a plane passing from the front to the back of the oven 100. FIG. 4 is a back view of the oven 100 with body 150 panels removed to show various portions of the second air circulation system in accordance with an example embodiment. FIG. 5 is a rear perspective view of the oven 100 with body 150 panels removed to show various portions of the second air circulation system in accordance with an example embodiment. FIG. 6 is a top view of an attic portion of the oven 100 to show various portions of the second air circulation system in accordance with an example embodiment. FIG. 7 is a cross sectional view of the attic portion of the oven 100 to show where air flows in the attic portion of the second air circulation system in accordance with an example embodiment. FIG. 8 is a side view of a cross section taken through the center of the attic portion from back to front in accordance with an example embodiment.

Referring primarily to FIGS. 3-8, the basement (or basement region 300) of the oven 100 is defined below the cooking chamber 102, and includes an inlet cavity 310. The inlet cavity 310 is generally forced to a relatively low pressure when the cooling fan 290 is in operation because the inlet 292 of the cooling fan 290 is operably coupled to the inlet cavity 310. The cooling fan 290 of this example is a centrifugal fan that draws air in closer to its axis of rotation and then uses an impeller to force air radially outward (i.e., perpendicularly away from the shaft or axis of rotation). The use of a centrifugal fan may allow a single phase, two-coil, AC fan to be employed so that no DC power conversion is needed (as would likely be the case with an axial fan). In some cases, the cooling fan 290 may continuously operate at a single speed regardless of whether or not the first energy source 200 is operational. However, in other example embodiments, the cooling fan 290 could be programmed to operate at a slower speed when the first energy source 200 is not operational, and at a higher speed when the first energy source 200 is operational.

During operation, air is drawn into the inlet cavity 310 through the inlet array 152 and is further drawn into the cooling fan 290 before being forced radially outward (as shown by arrow 315) away from the cooling fan 290 into a region (e.g., transfer duct 320) that is isolated from the inlet cavity 310 except via inlet air that passes through the cooling fan 290. The transfer duct 320 is operably coupled to a riser duct 330 (e.g., a chimney) that extends from the basement region 300 to the attic (or attic region 340) to turn air upward (as shown by arrow 315). Air is forced upward through the riser duct 330 into the attic region 340, which is where components of the control electronics 220 are disposed. The air then cools the components of the control electronics 220 before exiting the body 150 of the oven 100 via the outlet louvers 154. The components of the control electronics 220 may include power supply electronics 222, power amplifier electronics 224 and display electronics 226.

Air is guided to the attic region 340 via the riser duct 330, which extends rearward of the cooking chamber 102 and plenum and void space inside which the airflow generator 212 of the second energy source 210 is provided, along a rear wall of the oven 100. In particular, the riser duct 330 includes a rear wall 332 that may be formed by a rear panel of the body 150 of the oven 100, or may sit proximate to such rear panel. The riser duct 330 also includes a first inclined wall 334 which tapers at an angle extending from the transfer duct 320 to a front wall 336 of the riser duct 330. The front wall 336 extends upwardly away from the transfer duct 320 in a direction substantially parallel to the rear wall 332. The top of the front wall 336 meets a second inclined wall 338, which opens away from the rear wall 332 to open into an inlet header 400 in the attic region 340. The front wall 336, rear wall 332 and first and second inclined walls 334 and 338 each extend laterally between first and second sidewalls 337 and 339. As shown in FIGS. 4 and 5, the first and second sidewalls 337 and 339 may be centrally located along the back of the oven 100, and may be separated from each other by a distance that is less than one third the total width of the oven 100.

The riser duct 330 of an example embodiment blocks access to the airflow generator 212. Thus, some examples may make the riser duct 330 relatively easy to remove so that easy access can be obtained to the airflow generator 212 (and air heater 214) for maintenance or repair. In particular, some example embodiments may provide a limited number of fasteners (e.g., 4 screws) to be removed to allow the entire riser duct 330 to be removed in one piece to expose the airflow generator 212 (and air heater 214).

Upon arrival of air into the attic region 340, the air is initially guided from the riser duct 330 to the into an inlet header 400. The inlet header 400 is isolated from remaining portions of the attic region 340 to guide air received from the riser duct 330 into a power amplifier casing 420. The power amplifier casing 420 may house the power amplifier electronics 224. In particular, the power amplifier electronics 224 may sit on an electronic board to which all such components are mounted. The power amplifier electronics 224 may therefore include one or more power amplifiers that are mounted to the electronic board for powering the antenna assembly 130. Thus, the power amplifier electronics 224 may generate a relatively large heat load. To facilitate dissipation of this relatively large heat load, the power amplifier electronics 224 may be mounted to one or more heat sinks 422. In other words, the electronic board may be mounted to the one or more heat sinks 422. The heat sinks 422 may include large metallic fins that extend away from the circuit board to which the power amplifier electronics 224 are mounted. Thus, the fins may extend downwardly (toward the cooking chamber 102). The fins may also extend in a transverse direction away from a centerline (from front to back) of the oven 100 to guide air provided into the power amplifier casing 420 from the inlet header 400 away from the centerline and past the fins of the heat sinks 422.

FIG. 7 illustrates arrow 430 showing the direction that air moves through the inlet header 400 and toward the heat sinks 422 within the power amplifier casing 420. A flow divider 440 may be provided in between the heat sinks 422 to split the flow of air substantially equally between the heat sinks 422 on each respective side of the flow divider 440. Arrows 432 show the air movement after splitting at the flow divider 440 to direct the air through the fins of the heat sinks 422. Of note, the flow divider 440 of this example is symmetrical in shape due to the fact that the cooling fan 290 is a centrifugal fan, which provides a substantially even flow of air up the riser duct 330 and through the inlet header 400. However, in example embodiments in which the cooling fan 290 is embodied as an axial fan (e.g., with placement being within the riser duct 330), the flow may not be even through the inlet header 400, but may be heavier on one side of the flow divider 440 than the other. In such an example, the flow divider 440 may not be symmetrical, but may instead direct flow from the side of the inlet header 400 that has heavier flow toward the other side to even out the flow through the respective heat sinks 422.

After air exits the space between fins of the heat sinks 422, the air is released into the remainder of the attic region 340 and is still at a pressure higher than ambient pressure. Accordingly, the air spreads through the attic region 340 to cool the power supply electronics 222 and the display electronics 226. The attic region 340 may be defined by frame members 450 that include openings 455 formed therein. The openings 455 may be aligned with the outlet louvers 154 of the oven body 150 to allow air to exit the oven body 150. As can be appreciated from FIG. 1 and FIGS. 3-7, the openings 455 and the outlet louvers 154 are provided on the top of the oven 100 at the back and rear sides of the oven 100. Thus, air leaving the attic region 340 cannot be recycled through intake via the inlet array 152 since the air leaving the attic region 340 has removed heat from the control electronics 220 and will be expected to rise after being expelled from the attic region 340. This prevents recycling of cooling air, and further ensures effective cooling of the control electronics 220.

Another opening 458 (or set of openings) may also be provided at a front end of the frame members 450 to allow air in the attic region 340 to cool the display electronics 226. Thus, the area in which the display electronics 226 are provided may also be at a pressure higher than ambient pressure to prevent dust or exhaust gases from opening of the oven door 104 from entering into the area in which the display electronics 226 are housed.

In an example embodiment, a protruding member 460 may also be provided forward of the power amplifier casing 420, as shown in FIGS. 3, 5 and 8, to provide a C-shaped channel to protect the power amplifier electronics 224 from any steam, hot air or other exhaust that may be expelled from the cooking chamber 102 when the door 104 is opened. The C-shaped channel may extend laterally across the front of the power amplifier casing 420 to keep any steam or exhaust from contacting the power amplifier electronics 224 before being mixed with cooling air that has exited the fins of the heat sinks 422. In some cases, the C-shaped channel (and the protruding member 460 that forms it) may extend the length of the power amplifier casing 420 in a direction substantially parallel to the direction of extension of the top of the door 104 and be located between the door 104 and the power amplifier electronics 224. More particularly, the C-shaped channel may be disposed inside the attic region 340 proximate to a corner of the attic region 340 that is closest to the door 104.

As can be appreciated from the description above, the cooling fan 290 defines a boundary between an area of relatively low pressure (e.g., lower than ambient pressure) in the basement region 300, and specifically in the inlet cavity 310, and an area of relatively high pressure (e.g., higher than ambient pressure) in the transfer duct 320, the riser duct 330 and the attic region 340. This arrangement ensures that all low pressure regions within the second air circulation system are maintained below (e.g., at a lower elevation than) the cooking chamber 102, while the control electronics 220 are maintained above the cooking chamber 220 in a higher pressure region (e.g., the attic region 340). By placing the compartment in which the control electronics 220 are located under a positive pressure, it can generally be ensured that ambient air is not drawn into the attic region 340. Instead, air which has been drawn through the basement region 300 and the riser duct 330 is expelled from the attic region 340 (e.g., via the outlet louvers 154). Moreover, it should be noted that the air drawn up the riser duct 330 and into the attic region 340 has generally been filtered by the inlet array 152. Thus, the air drawn into the attic region 340 is generally filtered or clean air relative to ambient air. Finally, since the control electronics 220 are positioned at a high elevation within the oven 100 (e.g., above the cooking chamber 102), to the extent dust or debris happen to get into the attic region 340, such dust and debris may tend to fall downward toward the basement region 300 rather than accumulate in the attic region 340 where cooling processes may be interference.

Another benefit of this arrangement can be appreciated by virtue of the fact that the components (e.g., filters) forming the inlet array 152 are relatively easy for the operator to remove. With a relatively simple removal of the components forming the inlet array 152, access to the basement region 300 (or at least the inlet cavity 310) may be afforded to the operator to enable the operator to clean dust or debris accumulated in the inlet cavity 310 along with cleaning of the filters of the inlet array 152 during routine maintenance or cleaning procedures. Thus, dust and debris (if any) would in any case tend to accumulate far from the control electronics 220 and in a place that is relatively easy to clean.

In an example embodiment, an oven may be provided. The oven may include an oven body, a cooking chamber disposed in the oven body and configured to receive a food product, an RF heating system configured to provide RF energy into the cooking chamber using solid state electronic components, and an air circulation system configured to provide air for cooling the solid state electronic components. The air circulation system may include an inlet cavity disposed below the cooking chamber, an attic region disposed above the cooking chamber and housing the solid state electronic components, and a cooling fan. The cooling fan may isolate the inlet cavity from the attic region to maintain the inlet cavity at a pressure below ambient pressure to draw cooling air into the inlet cavity via an inlet array, and to maintain the attic region at a pressure above ambient pressure to discharge air that has cooled the solid state electronic components from the oven body.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the cooling fan may be a centrifugal fan disposed below the cooking chamber. In some embodiments, an outlet of the cooling fan may be operably coupled to a riser duct that carries the cooling air upward from below the cooking chamber to the attic region. In such an example, the oven may further include a second air circulation system configured to provide heated air into the cooking chamber. The first and second air circulation systems may be isolated from each other. The riser duct may be disposed rearward of an airflow generator of the second air circulation system, and the riser duct maybe removable to enable access to the airflow generator. In some example embodiments, the riser duct may include a first inclined wall disposed proximate to an entrance of the riser duct leading away from the cooling fan and a second inclined wall disposed proximate to the attic region. The first inclined wall may be tapered to restrict the cross sectional area of the riser duct while the riser duct passes the airflow generator of the second air circulation system, and the second inclined wall may expand the cross sectional area of the riser duct as the riser duct opens into the attic region. In an example embodiment, the cooling air exits the riser duct into an inlet header disposed in the attic region and is directed from the inlet header to a heat sink operably coupled to power amplifier electronics configured to generate the RF energy. In some cases, a flow divider is provided between the heat sink and a second heat sink positioned in the attic region symmetrically with respect to the heat sink to split the cooling air between the heat sink and the second heat sink. In an example embodiment, display electronics are cooled by the cooling air after the cooling air passes by the heat sink. In some examples, a protruding member is disposed between the power amplifier electronics and a portion of the attic region that is proximate to a door of the oven to prevent air leaving the cooking chamber from direct contact with the power amplifier electronics. In an example embodiment, the inlet array may be disposed only at front and side portions of the oven body below the cooking chamber, and outlet louvers may be disposed at top and rear portions of the oven body proximate to the attic region to prevent recirculation of the cooling air.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

an oven body;

a cooking chamber disposed in the oven body and configured to receive a food product;

a radio frequency (RF) heating system configured to provide RF energy into the cooking chamber using solid state electronic components; and an air circulation system configured to provide air for cooling the solid state electronic components, wherein the air circulation system comprises:

an inlet cavity and a transfer duct disposed in a basement region below the cooking chamber, an attic region disposed above the cooking chamber and housing the solid state electronic components, and a cooling fan disposed in the basement region to separate the inlet captivity from the transfer duct, isolating the inlet cavity from the attic region to maintain the inlet cavity at a pressure below ambient pressure to draw cooling air into the inlet cavity via an inlet array, and to maintain the attic region at a pressure above ambient pressure to discharge air that has cooled the solid state electronic components from the oven body, wherein an outlet of the cooling fan is operably coupled to a riser duct that carries the cooling air upward from below the cooking chamber to the attic region via the transfer duct and wherein the cooling fan defines a boundary between an area of pressure below ambient pressure in the inlet cavity of the basement region of the oven and an area of pressure above ambient pressure in the riser duct, the transfer duct and the attic region.

2. The oven of claim 1, wherein the cooling fan comprises a centrifugal fan disposed below the cooking chamber.

3. The oven of claim 1, wherein the oven further comprises a second air circulation system configured to provide heated air into the cooking chamber, the first and second air circulation systems being isolated from each other, and wherein the riser duct is disposed rearward of an airflow generator of the second air circulation system, the riser duct being removable to enable access to the airflow generator.

4. The oven of claim 1, wherein the riser duct comprises a first inclined wall disposed proximate to an entrance of the riser duct leading away from the cooling fan and a second inclined wall disposed proximate to the attic region.

5. The oven of claim 1, wherein the cooling air exits the riser duct into an inlet header disposed in the attic region and is directed from the inlet header to a heat sink operably coupled to power amplifier electronics configured to generate the RF energy.

6. The oven of claim 5, wherein a flow divider is provided between the heat sink and a second heat sink positioned in the attic region symmetrically with respect to the heat sink to split the cooling air between the heat sink and the second heat sink.

7. The oven of claim 5, wherein display electronics are cooled by the cooling air after the cooling air passes by the heat sink.

8. The oven of claim 5, wherein a protruding member is disposed between the power amplifier electronics and a portion of the attic region that is proximate to a door of the oven to prevent air leaving the cooking chamber from direct contact with the power amplifier electronics.

9. The oven of claim 1, wherein the inlet array is disposed only at front and side portions of the oven body below the cooking chamber, and wherein outlet louvers are disposed at top and rear portions of the oven body proximate to the attic region to prevent recirculation of the cooling air.

10. An air circulation system for an oven comprising a cooking chamber configured to receive a food product and a radio frequency (RF) heating system configured to provide RF energy into the cooking chamber using solid state electronic components, the air circulation system being configured to provide air for cooling the solid state electronic components, the air circulation system comprising:

an inlet cavity and a transfer duct disposed in a basement region below the cooking chamber;

an attic region disposed above the cooking chamber and housing the solid state electronic components; and a cooling fan disposed in the basement region to separate the inlet cavity from the transfer duct, isolating the inlet cavity from the attic region to maintain the inlet cavity at a pressure below ambient pressure to draw cooling air into the inlet cavity via an inlet array, and to maintain the attic region at a pressure above ambient pressure to discharge air that has cooled the solid state electronic components from an oven body of the oven, wherein an outlet of the cooling fan is operably coupled to a riser duct that carries the cooling air upward from below the cooking chamber to the attic region via the transfer duct and wherein the cooling fan defines a boundary between an area of pressure below ambient pressure in the inlet cavity of the basement region of the oven and an area of pressure above ambient pressure in the riser duct, the transfer duct and the attic region.

11. The air circulation system of claim 10, wherein the cooling fan comprises a centrifugal fan disposed below the cooking chamber.

12. The air circulation system of claim 10, wherein the oven further comprises a second air circulation system configured to provide heated air into the cooking chamber, the first and second air circulation systems being isolated from each other, and wherein the riser duct is disposed rearward of an airflow generator of the second air circulation system, the riser duct being removable to enable access to the airflow generator.

13. The air circulation system of claim 10, wherein the riser duct comprises a first inclined wall disposed proximate to an entrance of the riser duct leading away from the cooling fan and a second inclined wall disposed proximate to the attic region.

14. The air circulation system of claim 10, wherein the cooling air exits the riser duct into an inlet header disposed in the attic region and is directed from the inlet header to a heat sink operably coupled to power amplifier electronics configured to generate the RF energy.

15. The air circulation system of claim 14, wherein a flow divider is provided between the heat sink and a second heat sink positioned in the attic region symmetrically with respect to the heat sink to split the cooling air between the heat sink and the second heat sink.

16. The air circulation system of claim 14, wherein display electronics are cooled by the cooling air after the cooling air passes by the heat sink.

17. The air circulation system of claim 14, wherein a protruding member is disposed between the power amplifier electronics and a portion of the attic region that is proximate to a door of the oven to prevent air leaving the cooking chamber from direct contact with the power amplifier electronics.

18. The air circulation system of claim 10, wherein the inlet array is disposed only at front and side portions of the oven body below the cooking chamber, and wherein outlet louvers are disposed at top and rear portions of the oven body proximate to the attic region to prevent recirculation of the cooling air.

* * * * *